United States Patent [19]

Saarloos

[11] 4,131,971

[45] Jan. 2, 1979

[54] PANEL ASSEMBLY HINGE

[75] Inventor: Pieter Saarloos, Loon op Zand, Netherlands

[73] Assignee: Breedveld Interieurwerken B.V., Rotterdam, Netherlands

[21] Appl. No.: 783,831

[22] Filed: Apr. 1, 1977

[30] Foreign Application Priority Data

Apr. 6, 1976 [NL] Netherlands ..... 7603602

[51] Int. Cl.[2] ..... E05D 7/00

[52] U.S. Cl. ..... 16/150; 16/DIG. 13; 160/84 R; 160/231 A

[58] Field of Search ..... 16/150, DIG. 13, 128 R; 160/84 R, 231 A, 231 R; 220/334, 339

[56] References Cited

U.S. PATENT DOCUMENTS

| | | | |
|---|---|---|---|
| 3,032,808 | 5/1962 | Fleming | 16/150 |
| 3,053,318 | 9/1962 | Artman | 160/231 A |
| 3,232,333 | 2/1966 | Dixon | 160/231 A |
| 3,302,690 | 2/1967 | Hurd | 160/231 A |
| 3,361,189 | 1/1968 | Dixon et al. | 160/231 A |
| 3,629,901 | 12/1971 | Wolf et al. | 16/150 |
| 3,751,760 | 8/1973 | Wakeman | 16/150 |

FOREIGN PATENT DOCUMENTS

| | | | |
|---|---|---|---|
| 2308773 | 4/1976 | France | 160/231 A |

*Primary Examiner*—James Kee Chi
*Attorney, Agent, or Firm*—John P. Snyder

[57] ABSTRACT

The invention relates to a hinge, particularly suitable for use between two parts to be mounted in relatively pivotable fashion, one part being made from compressed material, for example, board of wood cuttings, used in the furniture industry; the hinge according to the invention is provided with at least one anchoring element having a strip to be adhered to the part of compressed material and by a pliable element to be clamped to the anchoring element and connected with the other part; the advantage is to be seen in that first an anchoring element has to be mounted on the compressed material, onto which the flexible element can be subsequently clamped.

7 Claims, 4 Drawing Figures

FIG.1
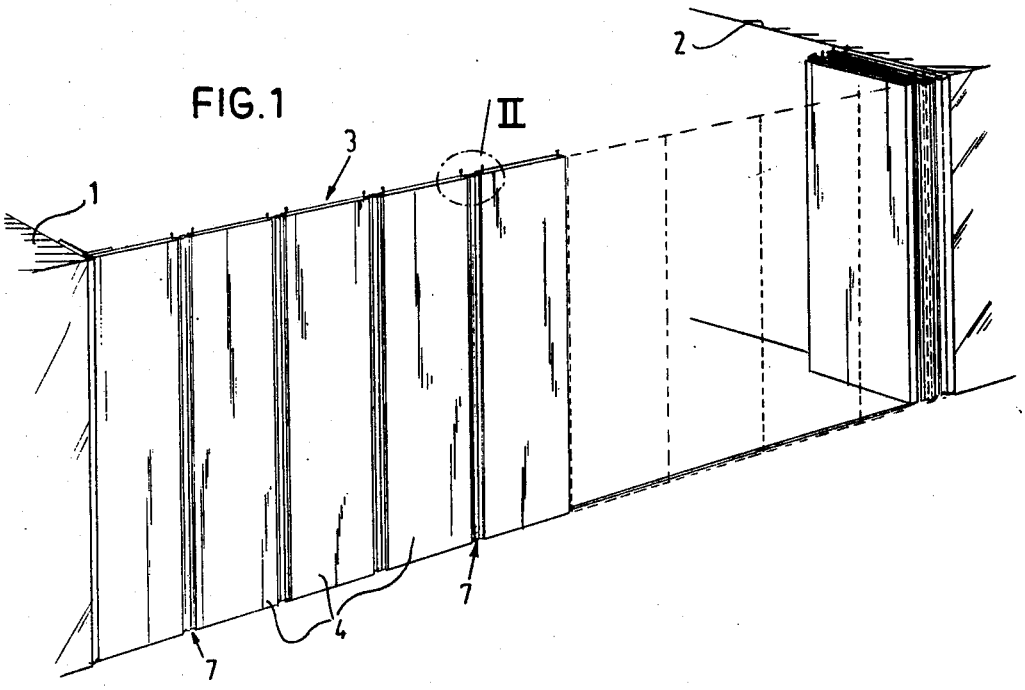
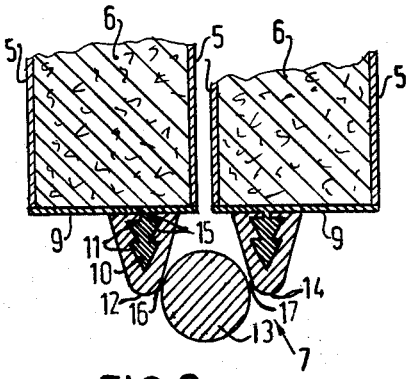
FIG.2
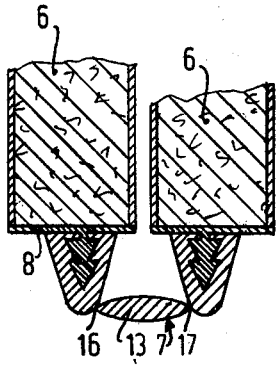
FIG.3
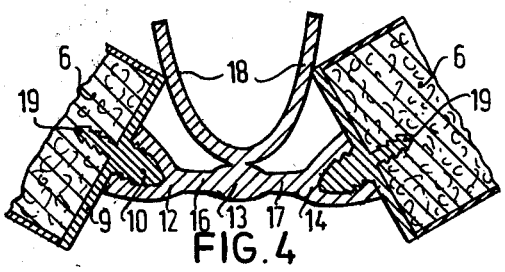
FIG.4

PANEL ASSEMBLY HINGE

The invention relates to a hinge, particularly suitable for use between two parts to be mounted in relatively pivotable fashion, one part being made from compressed material, for example, board of wood cuttings.

In the furniture industry boards of compressed material with or without veneer on one or on both sides are frequently employed. Hitherto it has been common practice to mount the door panels by means of hinge elements to the door post or the wall of the piece of furniture, the hinges being secured by means of screws or the like. It has been found that the screws find a poor hold in the compressed material such as board of wood cuttings.

The invention has for its object to provide a hinge which not only has a better grip, but can also be mounted within a shorter period of time.

The invention provides a hinge which is characterized by at least one anchoring element having a strip to be adhered to the part of compressed material and by a pliable element to be clamped to the acnhoring element and connected with the other part.

The invention is based on the idea that first an anchoring element has to be mounted on the compressed material, onto which the flexible element can be subsequently clamped. The invention provides furthermore the advantage that, when the elements have to be stuck to the side edge of a panel, the conventional side gluing machines for applying a veneer layer to such a side edge can be employed. The flexible element may be constructed so that it can be fastened, for example, by means of screws to a post or the like of solid wood, after which the door panel need be mounted simply by clamping tightly the pliable element to the anchoring element.

According to the invention an advantageous joint is established between the two elements by means of a groove having at least one snapping edge and a spring to be firmly clamped therein having at least one cooperative snapping edge. Obviously the spring in the groove may be fastened to the best appropriate element.

In the event of a particularly small structure it is preferred to integrate the spring with the anchoring element and to make the spring and the adhesive strip from synthetic material.

If the hinge has to be mounted between two relatively pivotable parts both made from compressed material, an anchoring element can be stuck to each of the parts, whilst in accordance with the invention the pliable element of the hinge is provided with two relatively pliable strips for establishing the clamping joint with the two anchoring elements.

The pliable strips may have any appropriate shape to ensure an adequate angle of turn of the door panel. If two panels have to be relatively pivotable, for example, the panels of a folding-door, the hinge has to impart such a freedom of movement to the panels that they can be joined flat, when the folding-door is completely folded up. In a preferred embodiment of the invention it is proposed to provide a bridge strip between the two connecting strips of the hinge, with respect to which bridge strip the two connecting strips can be bent.

In the case of folding-doors or folding-walls it is important to minimize penetrating noise. Therefore, the hinge according to the invention not only covers the full length of the hinge side of the panels in order to avoid any opening, but is also provided in accordance with the invention with a thickened bridge strip, which minimizes the transfer of noise.

In order to further inhibit transfer of noise the thickened bridge strip may be provided with tags engaging by their free ends the side of the panels facing the source of noise.

The invention will be described more fully with reference to embodiments of a hinge employed on a folding-wall or a folding-door.

In the drawing

FIG. 1 is a perspective view of a folding-wall provided with a hinge structure embodying the invention, FIGS. 2 and 3 are plan views of two embodiments of the hinge used in the door shown in FIG. 1, the door panels being folded against one another, FIG. 4 shows a variant of the embodiment shown in FIG. 2, the panels being shown in the folded-out position.

FIG. 1 shows that a folding-wall or folding-door 3 is arranged between the opposite walls 1 and 2, said door comprising two wings to be folded against the associated wall.

Each door wing is equipped in this case with five panels 4, for example, of compressed material, such as board of wood cuttings (see the plan views of FIGS. 2 and 3). Each board 6 is coated on both sides with a veneer layer 5 matching the space in which the door or wall is used.

A hinge 7 is mounted throughout the height of a panel to the two adjacent side edges of two neighbouring panels 4. The hinge comprises on the one hand an anchoring element 8 formed by a strip 9 to be stuck to the side edge and having a spring 10 integrally formed on it. In this embodiment the spring covers the full length of the strip 9 and the spring 10 is provided with two snapping edges 11 projecting outwards on both sides. On the other hand the hinge comprises a pliable element formed by fastening strips 12 co-operating with the spring, by a bridge strip 13 and by a strip 14 similar to the strip 12. Each connecting strip 12 and 14 respectively is provided with a groove having snapping edges 15 corresponding with the snapping edges 11 so that upon depression of the spring 10 into the groove of the connecting strip 12 and 14 respectively a tight clamping joint is established between the two elements of the hinge. The three component strips 12, 13 and 14 are relatively pliable at the thin-section portions 16 and 17 respectively.

The bridge strip 13 shown in FIG. 2 has a circular cross-section as a result of which a hinge in this embodiment is particularly suitable for use on noise-inhibiting panels.

FIG. 3 shows a bridge strip, which is thinner but has sufficient width for allowing the panels 6 to be joined flat FIG. 4 shows a thick bridge strip 13 corresponding with that shown in FIG. 2, additional flags 18 being secured thereto, the free ends of which engage the sides of the panels 6. This provides an additional protection against noise transfer.

The adhesive strip 9 has such a width that the full side edge of a panel is covered, so that further finishing of the panel is redundant. It will be obvious that the hinges may be of any appropriate colour so that an aesthetically acceptable folding-wall 3 is obtained.

If desired, the adhesive strip may be provided on its side remote from the spring with a longitudinal ridge 19, which serves as a guide during the mounting operation with side gluing machines. The panel has to be previously provided with the groove.

Within the scope of the invention other embodiments are possible. If only one door panel has to be hinged to a stationary post, the strip 14 of the embodiment described above need not be secured to an anchoring strip 8. The part 14 may be adapted for screwing to the post, which may be of solid wood. Although it is advantageous to have an adhesive strip 9 covering the full length of the panel 6, so that a finishing operation on the side edge of such a panel may be omitted, the part 7 of the hinge need obviously have only small dimensions; it can be imagined to use three or four hinge elements in superposition.

Finally it should be noted that the bridge strip 13 may be completely omitted and the fastening strips 12 and 14 may have such a curved shape and such a cross-section that they are directly connected via a bending rim 16 or 17 with one another.

What is claimed is:

1. A hinge particularly for use between two parts to be mounted in relatively pivotable fashion, at least one part being made from compressed material, for example, board of wood cuttings, said hinge comprising a strip adhesively secured to the part of compressed material, at least one anchoring element carried by said strip, and a pliable element clamped to the anchoring element and being secured to the other part.

2. A hinged panel assembly comprising, in combination:

a panel of compressed material;

an anchoring strip extending along one edge of said panel and being adhesively secured thereto;

at least one anchoring element disposed on said anchoring strip, integral therewith and projecting therefrom;

a pliable element having one end adapted to be secured to a support or the like; and connecting means disposed on the other end of said pliable element for clampingly engaging said anchoring element thereby hingedly mounting said panel on said support or the like.

3. A hinge as defined in claim 2 wherein said anchoring element comprises a projecting ridge having an irregular shape in cross-section and said connecting means comprises a strip having a longitudinally extending groove of substantially like size and shape as said ridge, said groove clampingly receiving said ridge therewithin.

4. A hinge as defined in claim 2 wherein said anchoring strip and said anchoring element are integrally made from synthetic material.

5. An assembly as defined in claim 2 wherein said pliable element comprises a further connecting means and a bridge strip connecting the connecting means first mentioned to said further connecting means, a second panel of compressed material constituting said support or the like, and a further anchoring strip adhesively secured to an edge of said second panel and at least one further anchoring element disposed on and projecting from said further anchoring strip, said further connecting means clampingly engaging said further anchoring strip.

6. A hinge as claimed in claim 5 characterized in that the cross-section of the bridge strip is substantially circular.

7. A hinge as claimed in claim 5 characterized in that the bridge strip is provided with two flags each engaging one side of the hinging part.

* * * * *